US007775622B2

(12) United States Patent
Suzuki et al.

(10) Patent No.: US 7,775,622 B2
(45) Date of Patent: Aug. 17, 2010

(54) INKJET PRINTING APPARATUS AND PRELIMINARY DISCHARGE CONTROL METHOD OF SAID APPARATUS

(75) Inventors: Kazuo Suzuki, Yokohama (JP); Daigoro Kanematsu, Yokohama (JP); Rie Takekoshi, Kawasaki (JP); Mitsutoshi Nagamura, Tokyo (JP); Naoko Baba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/396,774

(22) Filed: Mar. 3, 2009

(65) Prior Publication Data

US 2009/0167802 A1 Jul. 2, 2009

Related U.S. Application Data

(63) Continuation of application No. 11/063,615, filed on Feb. 24, 2005, now Pat. No. 7,517,044.

(30) Foreign Application Priority Data

Mar. 1, 2004 (JP) ..... 2004-056663

(51) Int. Cl.
*B41J 2/165* (2006.01)

(52) U.S. Cl. ..... 347/22; 347/23; 347/35

(58) Field of Classification Search ..... 347/22, 347/23, 53, 35
See application file for complete search history.

(56) References Cited

U.S. PATENT DOCUMENTS

| | | | | |
|---|---|---|---|---|
| 4,176,363 | A | 11/1979 | Kasahara | 347/19 |
| 4,489,335 | A | 12/1984 | Watanabe et al. | 347/19 |
| 5,617,122 | A | 4/1997 | Numata et al. | 347/14 |
| 6,142,600 | A | 11/2000 | Takahashi et al. | |
| 6,394,571 | B1 | 5/2002 | Yano et al. | |
| 6,517,183 | B2 | 2/2003 | Bruch et al. | |
| 6,752,483 | B1 | 6/2004 | Vega et al. | |
| 7,517,044 | B2 * | 4/2009 | Suzuki et al. | 347/22 |
| 2003/0020773 | A1 | 1/2003 | Schantz et al. | 347/14 |

FOREIGN PATENT DOCUMENTS

| | | |
|---|---|---|
| JP | 6-40042 | 2/1994 |
| JP | 8044512 | 2/1996 |
| JP | 9201967 A | 8/1997 |
| JP | 2000233520 A | 8/2000 |
| JP | 2003285437 A | 10/2003 |

* cited by examiner

*Primary Examiner*—Huan H Tran
(74) *Attorney, Agent, or Firm*—Fitzpatrick, Cella, Harper & Scinto

(57) ABSTRACT

In an inkjet printing apparatus which performs printing on a printing medium using an inkjet printhead for discharging ink, preliminary discharge, where ink discharge irrespective of printing is performed at the time of print execution, is performed under a predetermined condition. The printing apparatus includes a control section and a setting section. The control section executes a preliminary discharge by the printhead, which has a plurality of discharge orifices, before a predetermined time has elapsed since a latest preliminary discharge, in printing of an image, and the setting section sets the predetermined time. The setting section obtains an elapsed time after executing the preliminary discharge until a discharge failure occurs in any one of the plurality of discharge orifices, and sets the elapsed time as the predetermined time.

6 Claims, 15 Drawing Sheets

FIG. 11

| STANDBY TIME SET WHEN NORMAL DISCHARGE IS NOT PERFORMED (sec) | NUMBER OF PRELIMINARY DISCHARGE |
|---|---|
| LESS THAN 2 | 22 |
| EQUAL TO OR MORE THAN 2 AND LESS THAN 4 | 20 |
| EQUAL TO OR MORE THAN 4 AND LESS THAN 6 | 18 |
| EQUAL TO OR MORE THAN 6 AND LESS THAN 8 | 16 |
| EQUAL TO OR MORE THAN 8 AND LESS THAN 10 | 14 |
| EQUAL TO OR MORE THAN 10 AND LESS THAN 12 | 12 |
| EQUAL TO OR MORE THAN 12 AND LESS THAN 14 | 10 |
| EQUAL TO OR MORE THAN 14 AND LESS THAN 16 | 8 |
| EQUAL TO OR MORE THAN 16 AND LESS THAN 18 | 6 |
| EQUAL TO OR MORE THAN 18 | 4 |

FIG. 12

| STANDBY TIME SET WHEN NORMAL DISCHARGE IS NOT PERFORMED (sec) | DENSITY OF PRELIMINARY DISCHARGE ON A SHEET |
|---|---|
| LESS THAN 6 | 4/10,000 |
| EQUAL TO OR MORE THAN 6 AND LESS THAN 10 | 3/10,000 |
| EQUAL TO OR MORE THAN 10 AND LESS THAN 14 | 2/10,000 |
| EQUAL TO OR MORE THAN 14 AND LESS THAN 18 | 1/10,000 |
| EQUAL TO OR MORE THAN 18 | 0 |

FIG. 13

| STANDBY TIME SET WHEN NORMAL DISCHARGE IS NOT PERFORMED (sec) | DENSITY OF PRELIMINARY DISCHARGE ON A SHEET | PRELIMINARY DISCHARGE INTERVAL ADDITION TIME (sec) |
|---|---|---|
| LESS THAN 2 | 4/10,000 | −2 |
| EQUAL TO OR MORE THAN 2 AND LESS THAN 4 | 4/10,000 | −1 |
| EQUAL TO OR MORE THAN 4 AND LESS THAN 6 | 4/10,000 | 0 |
| EQUAL TO OR MORE THAN 6 AND LESS THAN 10 | 3/10,000 | 0 |
| EQUAL TO OR MORE THAN 10 AND LESS THAN 14 | 2/10,000 | 0 |
| EQUAL TO OR MORE THAN 14 AND LESS THAN 18 | 1/10,000 | 0 |
| EQUAL TO OR MORE THAN 18 | 0 | 0 |

FIG. 15

| TIME LAG (msec) | NUMBER OF PRELIMINARY DISCHARGE |
|---|---|
| LESS THAN 1 | 4 |
| EQUAL TO OR MORE THAN 1 AND LESS THAN 1.1 | 6 |
| EQUAL TO OR MORE THAN 1.1 AND LESS THAN 1.2 | 8 |
| EQUAL TO OR MORE THAN 1.2 AND LESS THAN 1.3 | 10 |
| EQUAL TO OR MORE THAN 1.3 AND LESS THAN 1.4 | 12 |
| EQUAL TO OR MORE THAN 1.4 AND LESS THAN 1.5 | 14 |
| EQUAL TO OR MORE THAN 1.5 AND LESS THAN 1.6 | 16 |
| EQUAL TO OR MORE THAN 1.6 AND LESS THAN 1.7 | 18 |
| EQUAL TO OR MORE THAN 1.7 AND LESS THAN 1.8 | 20 |
| EQUAL TO OR MORE THAN 1.8 | 22 |

INKJET PRINTING APPARATUS AND PRELIMINARY DISCHARGE CONTROL METHOD OF SAID APPARATUS

This is application is a continuation of U.S. patent application Ser. No. 11/063,615, filed Feb. 24, 2005.

FIELD OF THE INVENTION

The present invention relates to an inkjet printing apparatus and a preliminary discharge control method of an inkjet printing apparatus, and more particularly, to a method of controlling an execution condition of preliminary discharge, where ink discharge irrespective of printing is performed at the time of print execution, in an inkjet printing apparatus which performs printing on a printing medium using an inkjet printhead for discharging ink.

BACKGROUND OF THE INVENTION

As a data output apparatus of word processors, personal computers, facsimile machines and so forth, printers capable of printing desired information such as texts and images on a sheet-type printing medium, e.g., paper, film and the like, are widely utilized.

Although various printing methods are available for such printers, recently an inkjet printing method has particularly attracted attention because of its capability to perform non-contact printing on a printing medium such as paper, ease of color printing, and low noise. Moreover, for a configuration of such printer, in general a serial printing method is widely adopted because of its low cost and ease of downsizing. According to the serial printing method, a printhead discharging ink in accordance with desired printing data is attached to a carriage and printing is performed by reciprocally scanning the carriage in a direction crossing to the conveyance direction of the printing medium (e.g., paper).

Many of the inkjet printers perform discharge irrespective of printing, which is called preliminary discharge. Note that preliminary discharge is to preliminarily discharge ink for recovery of the discharge state aside from the actual image data printing, and means a discharge operation that does not contribute to image printing. There are two main reasons to perform preliminary discharge.

The first reason is that, when printing is not performed for a long time, a volatile component (solvent) of ink evaporates from the nozzle end of the printhead and ink viscosity increases, causing discharge failure. To prevent such discharge failure and deterioration in printing quality caused by the discharge failure, preliminary discharge is performed.

Secondly, an inkjet printer generally performs suction recovery operation on regular basis to prevent ink solvent from evaporating from the nozzle end and to avoid discharge failure. To perform the suction recovery operation, the nozzle portion of the printhead is covered with a cap member and sucked by a pump so as to generate negative pressure in the cap member. As a result, ink in the inkjet head is eliminated through the nozzle. In a case of a printer which comprises a printhead for discharging plural colors of inks for color printing, if a nozzle that discharges plural colors of inks is covered with one cap for suction, the sucked ink is mixed in the cap, attached to the printhead orifice surface, and sucked back to the nozzle, causing color mixture in the nozzle. Such color mixture of ink can also occur when the discharge surface is cleaned (wiped) by a cleaning blade or the like.

To avoid printing with the mixed color ink, a countermeasure utilizing preliminary discharge is widely adopted. More specifically, the mixed color ink is eliminated by performing discharge irrespective of printing.

The preliminary discharge is performed immediately before the start of printing or during print execution. More specifically, immediately before the start of printing, preliminary discharge is performed to discharge unnecessary ink from the nozzle end portion, and the nozzle is filled with normal ink before starting the printing operation. During printing, a time period during which normal discharge is possible is calculated based on conditions such as printhead temperature, temperature and humidity in the printer, and so on. Preliminary discharge is performed at regular intervals that are equal to or shorter than the calculated time period.

Moreover, there is a known technique to perform preliminary discharge of microscopic dots, which are microscopic (small) enough so as not to affect the appearance, at microscopic density in a printing area (hereinafter referred to as preliminary discharge on a sheet). For instance, according to a known technique, preliminary discharge is performed on a sheet of printing paper immediately before discharging ink for image formation (e.g., Japanese Patent Application Laid-Open No. 06-040042).

To assure prevention of discharge failure and ink color mixture, it is necessary to increase the ink discharge amount of preliminary discharge or increase the frequency of preliminary discharge.

However, if the ink discharge amount of preliminary discharge is increased, the amount of wasted ink increases and the amount of ink that can be used in actual printing decreases, resulting in an increased ink cost. Furthermore, if the frequency of preliminary discharge is increased, the throughput decreases and the printhead life shortens due to an increased number of discharges.

Meanwhile, when a preliminary discharge is performed on a sheet of printing paper, little influence is imposed on the image quality in a case where the dots formed on the paper by preliminary discharge are microscopically small and the number of the dots is small, but unwelcome effects ensues in the image quality in a case where the ink discharge amount and the frequency of preliminary discharge are increased.

SUMMARY OF THE INVENTION

The object of the present invention is to provide an inkjet printing apparatus capable of suppressing a decrease in throughput and an increase in the amount of wasted ink, while preventing deterioration in printing quality.

Another object of the present invention is to provide a preliminary discharge control method of an inkjet printing apparatus capable of suppressing a decrease in throughput and an increase in the amount of wasted ink, while preventing deterioration in printing quality.

According to one aspect of the present invention, the above object is achieved by an inkjet printing apparatus for performing printing on a printing medium using an inkjet printhead which discharges ink, comprising: preliminary discharge execution means for executing preliminary discharge where ink discharge irrespective of printing is performed; detection means for obtaining information regarding a discharge state of the printhead by having the preliminary discharge execution means perform the preliminary discharge under a predetermined condition; and control means for controlling an execution condition of the preliminary discharge at the time of printing based on the information obtained by the detection means.

In other words, according to the present invention which provides an inkjet printing apparatus that performs printing on a printing medium using an inkjet printhead for discharging ink, preliminary discharge, where ink discharge irrespective of printing is performed at the time of print execution, is performed under a predetermined condition to obtain information regarding a discharge state of the printhead. Based on the obtained information, an execution condition of the preliminary discharge is controlled.

According to this control, an execution condition (parameter) of the preliminary discharge can appropriately be controlled in accordance with the discharge state of the printhead, in which the ink drying state and the increased viscosity of ink vary depending on individual differences, usage environment, usage histories (durability) and so on.

Therefore, it is possible to suppress a decrease in throughput and an increase in the amount of wasted ink, while preventing deterioration in printing quality.

The detection means may have the preliminary discharge execution means perform the preliminary discharge a plurality of number of times while changing the interval, and obtains as the information an interval at which ink is no longer discharged from the printhead.

Otherwise, the detection means obtains, as the information, time between designation of the preliminary discharge execution and ink detection.

The control means may control an interval of preliminary discharge execution, or an amount of ink discharged at the time of the preliminary discharge, as the execution condition of the preliminary discharge.

In a case where the preliminary discharge execution means executes the preliminary discharge by discharging ink on a printing medium at the time of printing execution, the control means may control ink discharge density on the printing medium as the execution condition of the preliminary discharge.

The control means may set the execution condition of the preliminary discharge based on a table generated in advance.

The construction of the printing apparatus may be such that the printing is performed by scanning the printhead in a direction crossing to a conveyance direction of the printing medium.

According to another aspect of the present invention, another object is achieved by a preliminary discharge control method of controlling an execution condition of preliminary discharge, where ink discharge irrespective of printing is performed at the time of print execution, in an inkjet printing apparatus which performs printing on a printing medium using an inkjet printhead for discharging ink, the method comprising: a detection step of causing execution of the preliminary discharge under a predetermined condition and obtaining information regarding a discharge state of the printhead; and a control step of controlling the execution condition of the preliminary discharge based on the obtained information.

Note that the above objects are also achieved by a computer program which causes a computer to execute the above-described preliminary discharge control method, or a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 11 is a table showing a relation between a standby time that has caused discharge failure and the amount (number) of preliminary discharge that prevents discharge failure according to a second embodiment;

FIG. 12 is a table showing a relation between a standby time that has caused discharge failure and a density of preliminary discharge on a sheet that prevents discharge failure according to a third embodiment;

FIG. 13 is a table showing a relation among a standby time that has caused discharge failure, a density of preliminary discharge on a sheet that prevents discharge failure, and an interval of preliminary discharge according to the third embodiment;

FIG. 15 is a table showing a relation between a time lag and the number of preliminary discharge according to the fourth embodiment.

DETAILED DESCRIPTION OF THE PREFERRED EMBODIMENTS

Preferred embodiments of the present invention will now be described in detail in accordance with the accompanying drawings. Note that each elements in the following embodiments is not intended to limit the scope of the invention, but is described only as an example.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

First Embodiment

Figure 8:
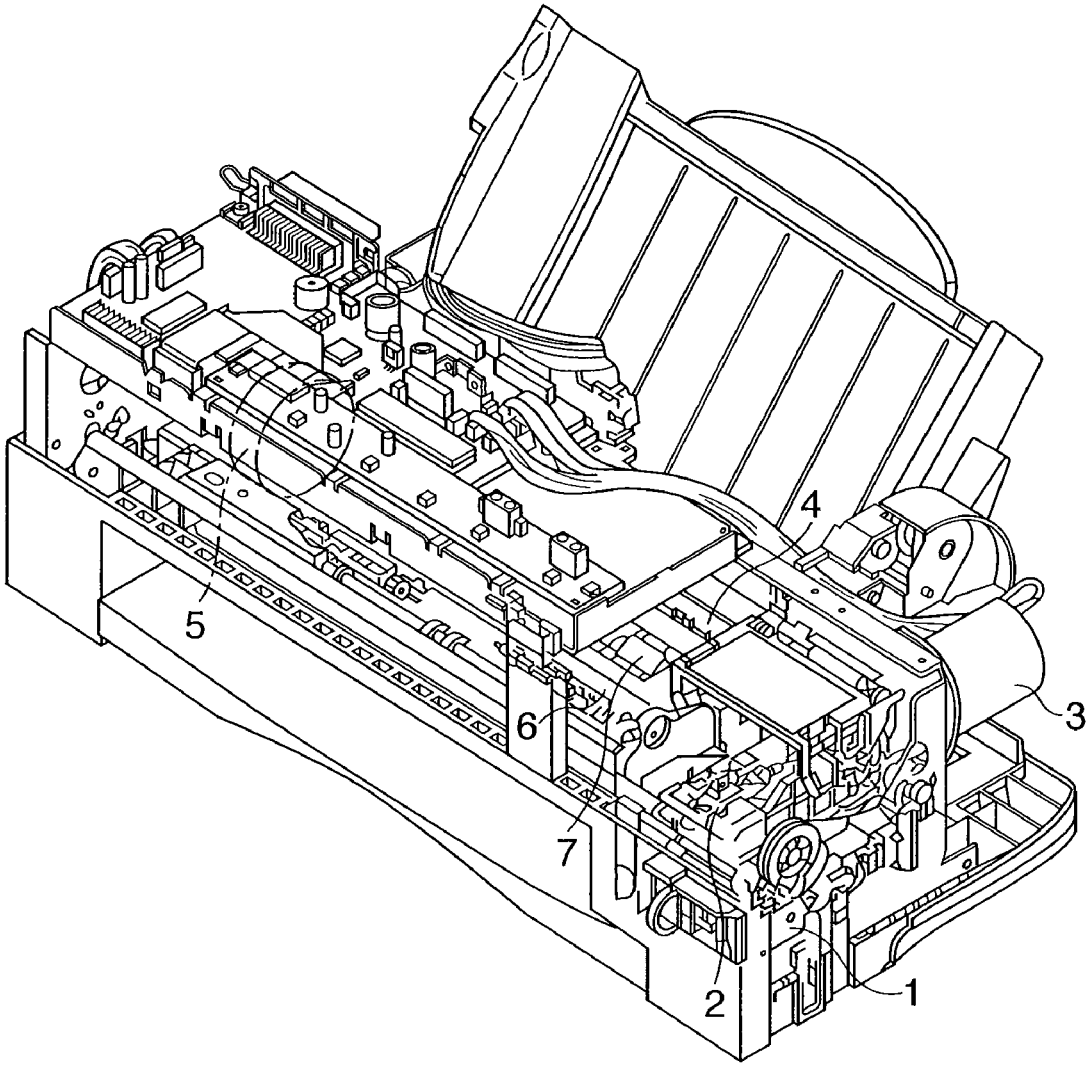
FIG. 8 is a perspective view showing an external appearance of a printing apparatus according to the first embodiment, whose cover is removed.

FIG. 8 is a perspective view showing an external appearance of an inkjet printing apparatus according to the first embodiment, whose cover is removed. The printing apparatus according to the first embodiment is a so-called serial-scan printer which forms images by scanning a printhead in the direction (main-scanning direction) crossing to the printing medium conveyance direction.

First, a brief operation at the time of printing is described. A printing medium is conveyed to a printing position by a sheet-feeding roller 6 which is driven by a sheet-feeding motor 5 through a gear. A carriage motor 3 is driven for scanning a carriage unit 2 through a carriage belt 4 in the direction crossing to the paper conveyance direction, and printing is performed for a bandwidth corresponding to the printhead's printing width. Then, the printing medium is conveyed for a predetermined distance. Alternate execution of the scanning and the printing medium conveyance realizes printing on a sheet of printing medium.

Note that in such serial scan, the so-called multi-pass printing method may also be adopted. Namely, instead of conveying a printing medium for each scan, a printing medium may be conveyed after plural numbers of times of scanning is performed, or printing for one band may be completed by performing, a number of times, printing of data that has been subjected to thinning by a predetermined mask corresponding to each scan, and conveying a printing medium for a distance corresponding to about 1/n of the band (n is a plurality).

Note that although the first embodiment employs the carriage belt 4 to transmit driving force from the carriage motor 3 to the carriage unit 2, other driving methods such as a lead screw may be employed in place of a carriage belt. The printing medium that has been fed is introduced to the printing position through the sheet-feeding roller 6 and a pressure roller 7.

Normally in an operation halt state, the discharge surface of the printhead is covered by a cap provided in a purge unit 1. Therefore, to perform printing, first the cap is released to enable scanning of the carriage in the main-scanning direction. In this state, when printing data for one scan is stored in the buffer, the carriage unit 2 is scanned by the carriage motor 3 for printing.

For water-soluble organic solvent to be used in ink of the present invention, most of the one used in the conventionally known ink can be utilized. More specifically, the following solvent can be used: alkyl alcohols having 1 to 5 carbons, e.g., methyl alcohol, ethyl alcohol, n-propyl alcohol, isopropyl alcohol, n-butyl alcohol, sec-butyl alcohol, tert-butyl alcohol, isobutyl alcohol, and n-pentanol; amides e.g., dimethylformamide and dimethylacetamide; ketones or ketone alcohols e.g., acetone and diacetone; ethers e.g., tetrahydrofuran and dioxane; oxyethylene or oxypropylene addition polymers, e.g., diethylene glycol, triethylene glycol, tetraethylene glycol, dipropylene glycol, tripropylene glycol, polyethylene glycol, and polypropylene glycol; alkylene glycol where the alkylene group has 2 to 6 carbon atoms, e.g., ethylene glycol, propylene glycol, trimethylene glycol, butylene glycol, 1,2, 6-hexanetriol, and hexylene glycol; thiodiglycol; glycerin; lower alkyl ethers of polyhydric alcohol, e.g., ethylene glycol monomethyl (or ethyl) ether, diethylene glycol monomethyl (or ethyl) ether, and triethylene glycol monomethyl (or ethyl) ether; lower dialkyl ethers of polyhydric alcohol, e.g., triethylene glycol dimethyl (or ethyl) ether and tetraethylene glycol dimethyl (or ethyl) ether; sulfolane, N-methyl-2-pyrrolidone, and 1,3-dimethyl-2-imidazolidinone.

In general, the content of the above-described water-soluble organic solvent accounts for 1 to 49 weight %, more preferably 2 to 30 weight % of the total weight of the ink. Furthermore, the above-described water-soluble organic solvent can be used individually or as a compound. In the case of using a combination of solvent, the most preferable composition of the solvent includes at least one type of water-soluble high boiling organic solvent such as polyhydric alcohol, e.g., diethylene glycol, triethylene glycol, and glycerin. Furthermore, in order to improve printing quality, metallic salt such as magnesium nitrate, calcium nitrate, and barium nitrate may be used as necessary.

Figure 9:
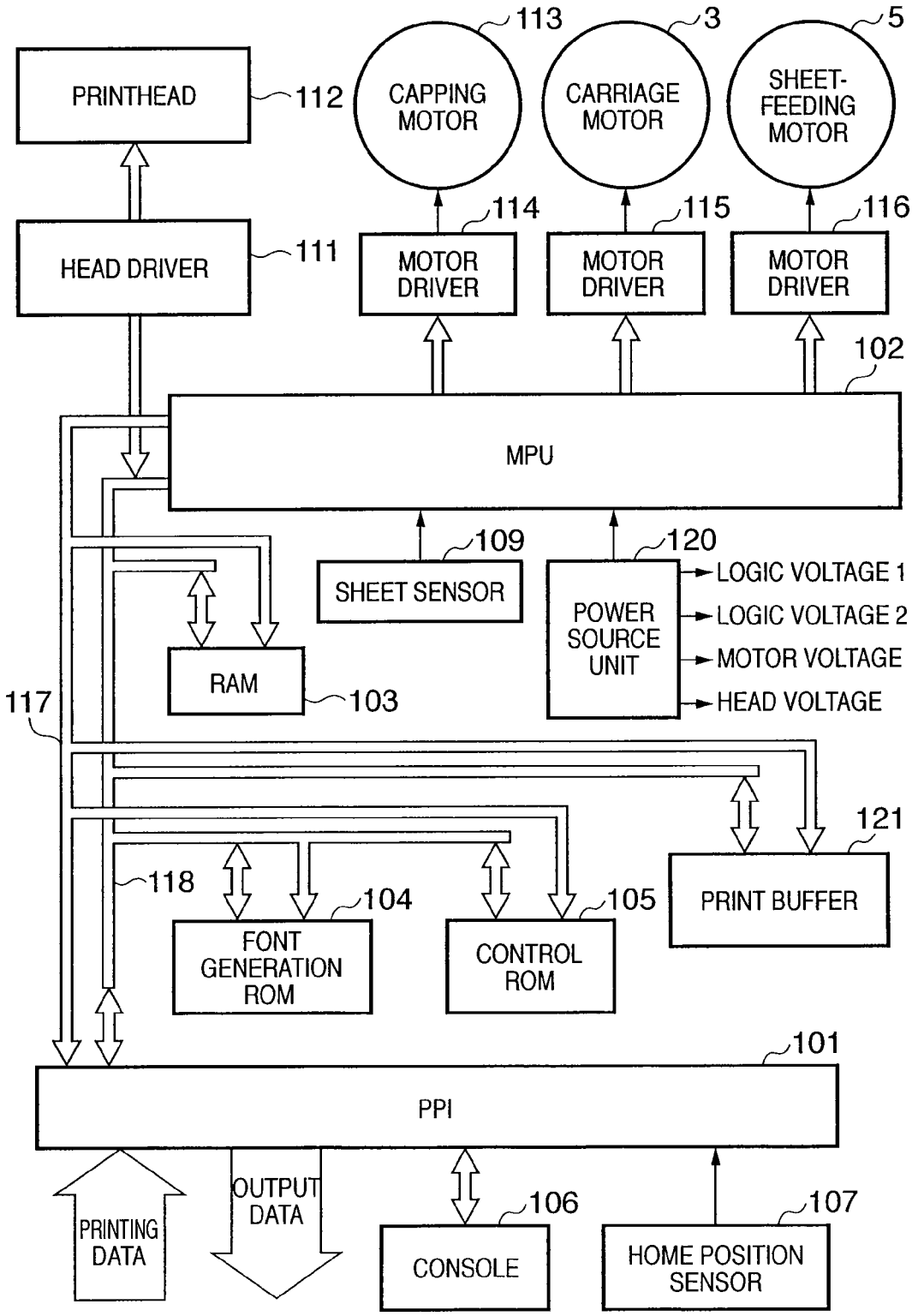
FIG. 9 is a block diagram showing a flow of signals and data in the printing apparatus according to the first embodiment.

A flow of signals and data in the printing apparatus according to the first embodiment is described with reference to FIG. 9. Referring to FIG. 9, numeral 101 denotes a programmable peripheral interface (PPI). The PPI receives command signals (command) and data signals, including printing data, which are transmitted from a host computer (not shown), transfers the signals to an MPU 102, controls a console 106, and receives input signals from a home position sensor 107 which detects the carriage at the home position. The micro processing unit (MPU) 102 controls respective units of the inkjet printing apparatus according to a control program stored in a control ROM 105.

Numeral 103 denotes RAM which is used as a storage of received signals, a work area of the MPU 102, and a temporary storage of various data. Numeral 104 denotes font generation ROM, which stores texts and pattern data for printing or the like corresponding to code data, and outputs various pattern data in accordance with inputted code data. Numeral 121 denotes a print buffer for storing data developed by the font generation ROM 104 or the like. The print buffer 121 has a capacity for m lines. Numeral 105 denotes a control ROM for storing various data and a control procedure executed by the MPU 102. The above-described units are controlled by the MPU 102 respectively via an address bus 117 and a data bus 118.

Numeral 3 denotes a carriage motor which causes the carriage unit 2 incorporating a printhead 112 to perform reciprocal scanning. Numeral 5 denotes a sheet-feeding motor for conveying a printing medium, such as paper, in a direction crossing to the carriage moving direction. Numeral 113 denotes a capping motor for driving the purge unit 1, which performs capping to prevent the nozzles from drying by driving a cap member to be pressed against the ink discharge orifices (not shown) of the printhead 112 so as to shield the ink discharge orifices against air, and which performs a wiping operation of ink or the like on the printhead discharge surface by activating a wiper. Numeral 115 denotes a motor driver for driving the carriage motor 3; 116, a motor driver for driving the sheet-feeding motor 5; and 114, a motor driver for driving the capping motor 113.

The console 106 includes key switches to be operated by a user and indication lamps. The home position sensor 107, provided in the neighborhood of the carriage home position, detects arrival when the carriage incorporating the printhead 112 reaches the home position.

Numeral 109 denotes a sheet sensor which detects existence/absence of a printing medium such as printing paper, i.e., detects whether or not a printing medium is supplied to the printing unit. The printhead 112 is an inkjet printhead which discharges an ink droplet by causing a change in the state of ink by film boiling using heat energy. The printhead 112 comprises m number of (e.g., 64) discharge orifices (not shown) and m number of heaters (not shown) corresponding to respective discharge orifices. Numeral 111 denotes a driver which drives the heaters of the printhead 112 in accordance with printing data signals. Numeral 120 denotes a power source unit for supplying a plurality of voltage to the above-described units, and comprises an AC adapter and a battery as a driving power source device.

In the above-described construction, the MPU 102 connected to a host device such as a computer via the PPI 101 controls printing operation based on data signals including a command and printing data transmitted from the host device, a control procedure of a program stored in the control ROM 105, and printing data stored in the RAM 103.

In the printing apparatus according to the present invention, when printing data is transmitted from the host device via a parallel port, an infrared port, a network or the like, normally a command is attached to the head portion of the printing data. The command describes the type of medium used in printing (plain paper, OHP paper, a medium such as glossy paper, transfer film, a poster board, or a special medium such as banner paper), the size of medium (A4, A4 letter, A3, B4, B5, envelope, or postcard), printing quality (draft, high quality, average quality, emphasis on particular color, monochrome/color), paper cassette (ASF, manual feed, supply bin 1, supply bin 2), and performing/not performing object automatic determination. The printing apparatus receives the command, determines the number of printing passes for multi-pass printing, the amount of ink discharge per unit area, a printing orientation and the like based on the various data stored in the memory area (105) normally called ROM, and performs printing. In some cases, a command indicative of information, such as whether or not to coat processed liquid, is transmitted.

In accordance with the above data, the printing apparatus reads data necessary for printing from the ROM 105 and performs printing based on the data. Besides the aforementioned data, the data read out of the ROM includes: the type of mask used at the time of printing each pass, a printhead driving condition, (e.g., pulse shape to be applied, pulse applying time), the size of droplet (liquid droplet), a paper-feed condition, carriage speed, and so on.

An ink tank for containing ink is formed with resin such as PP or PE by performing injection blow molding or the like, and assembled by a technique such as ultrasonic welding, heat welding, bonding, and fitting. The internal portion of the ink tank may have various forms: the exterior may serve as an ink chamber, the ink tank may internally have a bag filled with ink, or the ink tank may have a porous member inserted inside to hold ink and generate negative pressure at the same time. In a case where the ink tank has a negative pressure mechanism, the bag portion inside the tank is supported in the expanding direction by a spring mechanism or the like provided inside or outside the bag, thereby generating negative pressure.

As described above, to perform printing, the cap covering the discharge orifices in an operation halt state is released to enable scanning of the carriage, and then the carriage unit 2 is scanned by the carriage motor 3 when printing data for one scan is stored in the buffer. Between the cap release and the print start, the so-called preliminary discharge before printing is performed. Normally the number of preliminary discharge is constant or determined in accordance with the unoperated period. Further, the number of preliminary discharge may be set for each color.

Meanwhile, preliminary discharge during printing may be performed for the unused nozzles or for all nozzles including the used nozzles. For the used nozzles, the number of preliminary discharge may be reduced depending on the frequency of usage. The above-described preliminary discharge is performed in some cases for the entire head or for each head after a printing operation is halted and the printhead moves to a position where preliminary discharge can be performed, or in other cases, preliminary discharge is performed while a printing operation is performed so as to improve printing speed.

Figure 3:
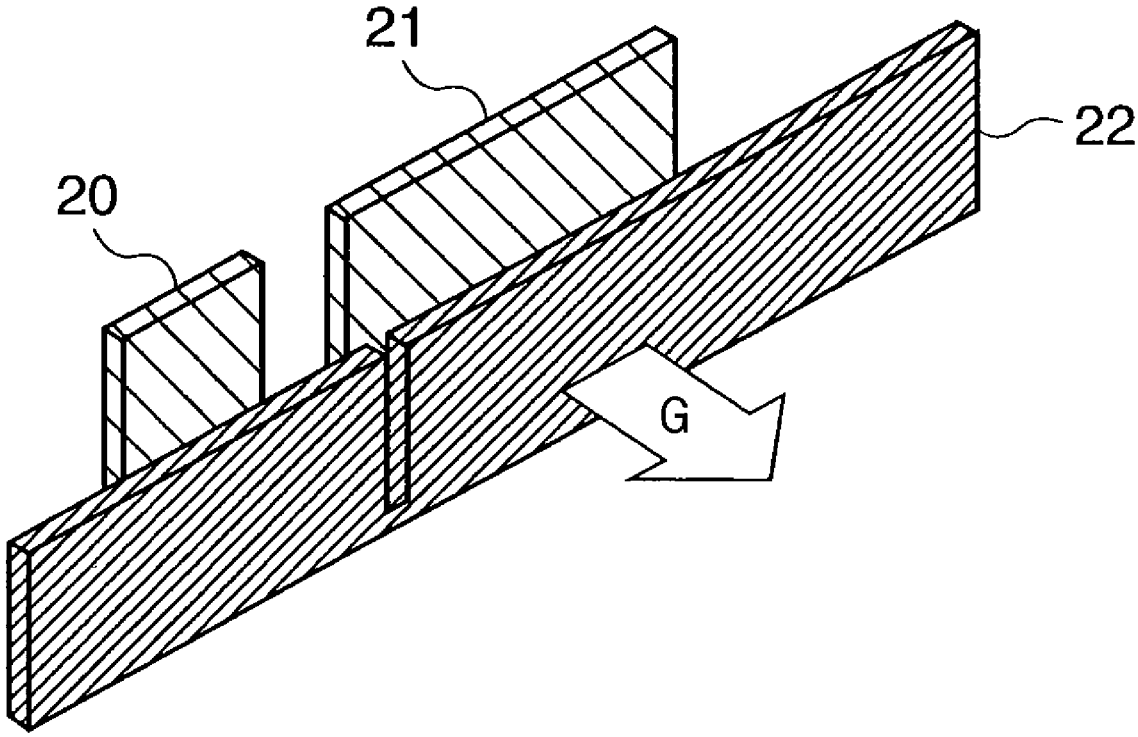
FIG. 3 is an external view of a wiper according to the first embodiment.
Figure 4:
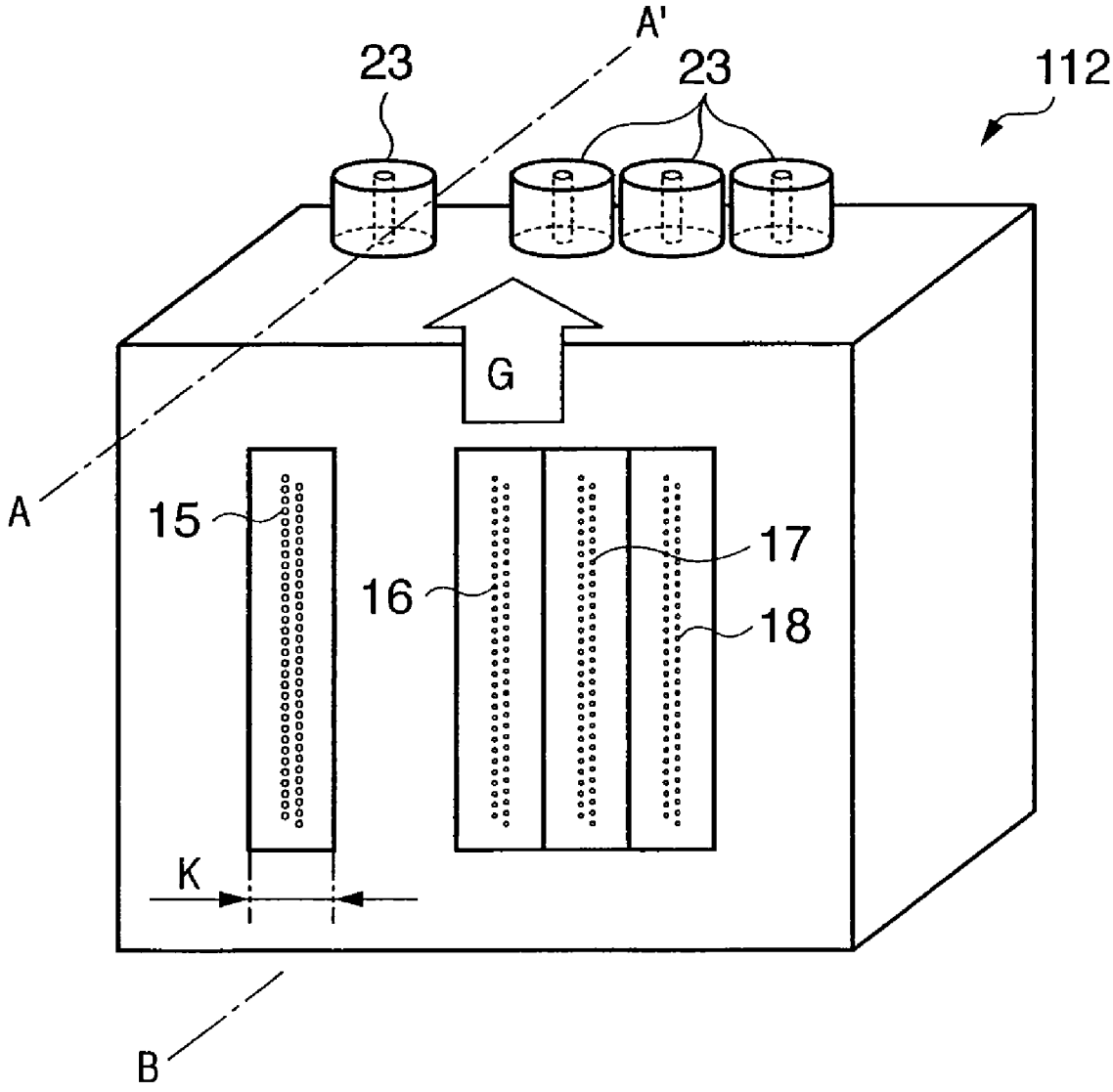
FIG. 4 is an external view of a printhead according to the first embodiment.

FIG. 3 is an external view of a wiper employed in the printing apparatus according to the first embodiment; FIG. 4, an external view of the printhead employed in the first embodiment; and FIG. 5, a cross section of the printhead employed in the first embodiment. The cross section in FIG. 5 shows a view cut along the lines A-A' and B-B' of the printhead in FIG. 4.

The printhead according to the present embodiment comprises, as shown in FIG. 4, a nozzle array 15 for black ink, a nozzle array 16 for cyan ink, a nozzle array 17 for magenta ink, and a nozzle array 18 for yellow ink. The black nozzle array 15 is provided on the black ink head (chip), and is arranged apart from the other three nozzle arrays provided on the color ink head (chip). Four ink supply openings 23 are provided to supply ink from the ink tank and then to be discharged from respective nozzle arrays. The black nozzle array 15 has 640 nozzles arranged in the direction G shown in FIG. 4 at the density of about 245 nozzles per centimeter. Each of the three color nozzle arrays 16 to 18 has 1280 nozzles in the direction G shown in FIG. 4 at the density of about 490 nozzles per centimeter.

Figure 5:
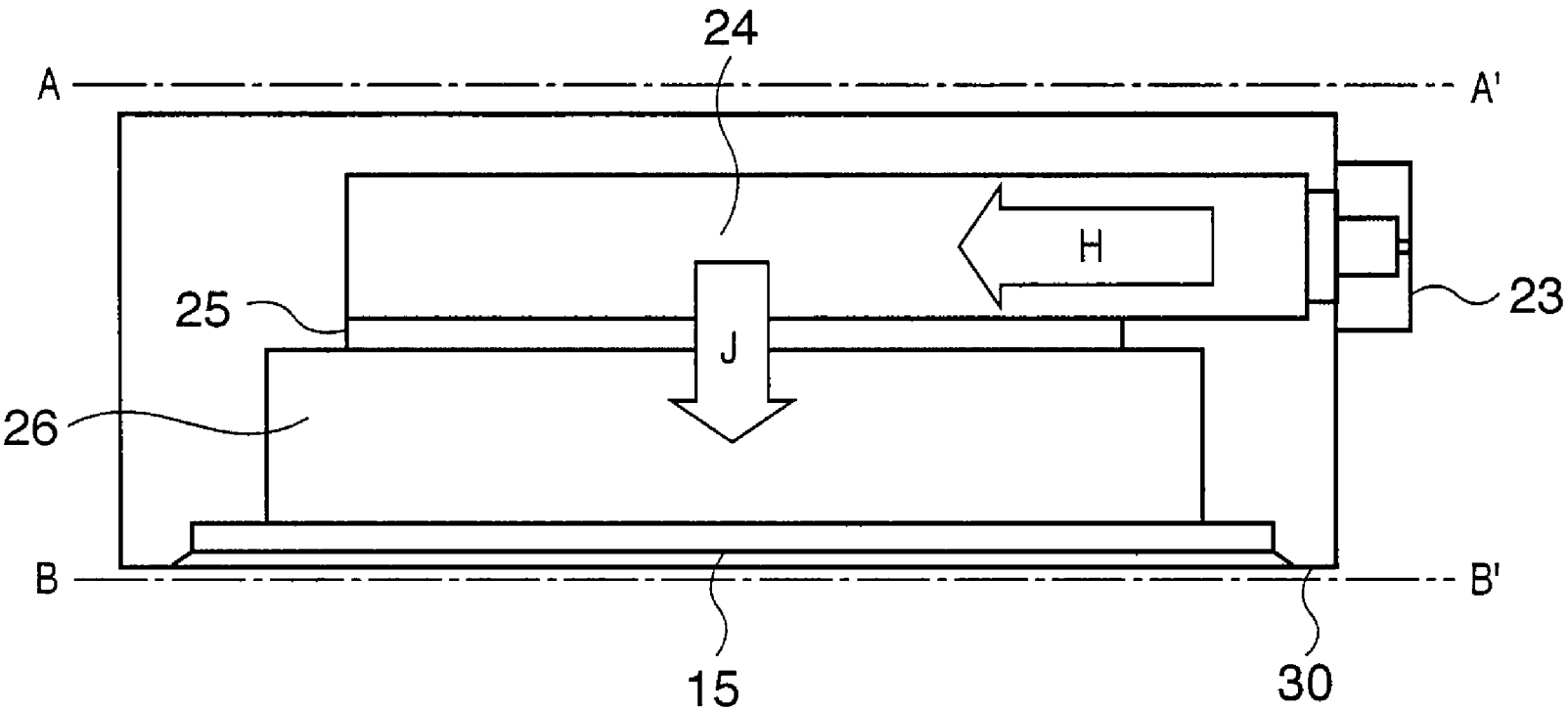
FIG. 5 is a cross section of the printhead shown in FIG. 4.

As shown in FIG. 5, the ink supplied from the ink supply openings 23 moves in the direction H and is introduced to a first ink chamber 24 defined by a filter 25 of the printhead. Then, the ink advances to the direction of arrow J in FIG. 5 while the filter 25 filters dust and other contaminants included in the ink. Then, the ink is introduced to a second ink chamber 26 and lead to liquid paths of the respective nozzles for ink discharge. Note that the discharge surface (orifices) of the nozzle array 15 is slightly recessed from the printhead surface 30 (will be referred to as a TAB surface) in order to prevent contact with a printing medium.

Furthermore, as shown in FIG. 3, the wiper according to the present embodiment comprises a black head wiper 20, a color head wiper 21, and a wiper 22 for the printhead TAB surface. The width of the black head wiper 20 is slightly smaller than the width K of the discharge surface shown in FIG. 4. This is because, as mentioned above, the discharge surface of each nozzle is slightly recessed from the TAB surface and the wiper gets into the recess surface to wipe off the discharge surface. Based on the similar reason, the width of the color head wiper 21 is slightly smaller than the total width of the three discharge surfaces of the nozzle arrays 16 to 18.

The wiper shown in FIG. 3 is mounted to a wiper holder (not shown) with a wiper fixing bracket (not shown). Positioning of the wiper is realized by fitting pins provided on the wiper holder into the openings of the wipers 20, 21 and 22. The wipers 20, 21 and 22 are driven by the capping motor 113 in the direction G shown in FIGS. 3 and 4 to wipe off the discharge surface and the TAB surface. When the wiping operation is completed, the carriage is evacuated outside the wiping area, and the wipers are driven in a reversed direction to return to the wiping start position.

Figure 6:
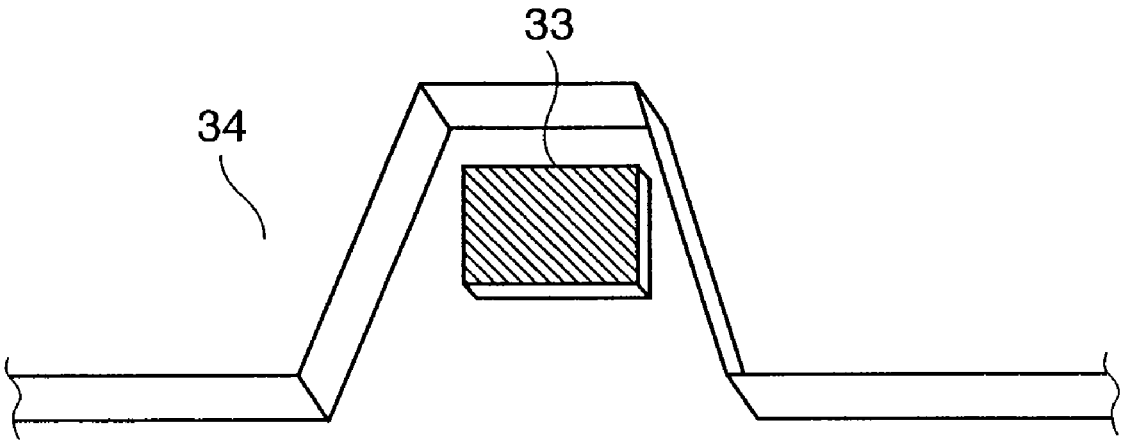
FIG. 6 is a partial enlarged view of a nozzle of the printhead shown in FIG. 4.
Figure 7:
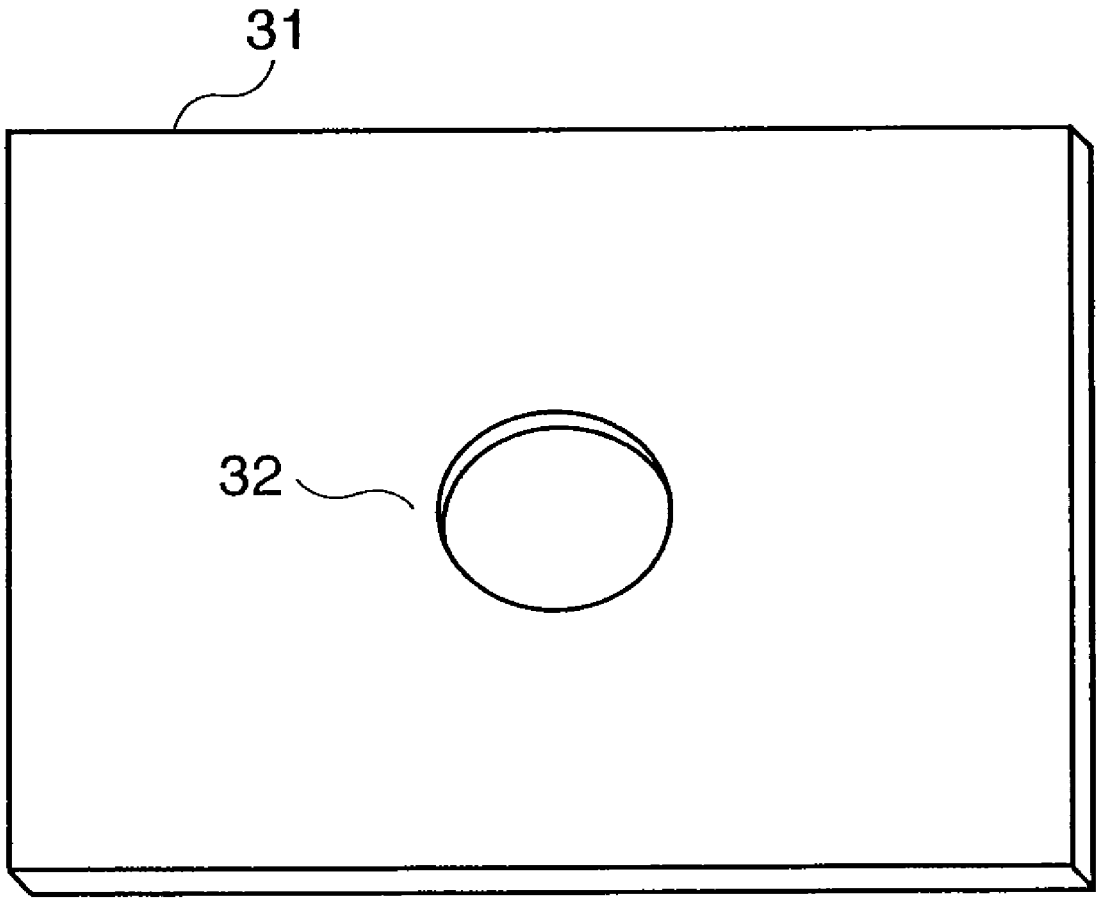
FIG. 7 is a partial enlarged view of an orifice portion of the printhead shown in FIG. 4.

FIGS. 6 and 7 are partial enlarged views of a nozzle of the printhead according to the present embodiment. The ink chamber is formed with a heater board comprising an orifice plate 31, a chamber-forming member 34, and a heater 33. The ink reserved in the chamber is heated by the heater 33 to cause bubble generation, pushed out of the orifice plate as the bubble expands, and discharged to a printing medium as a spherical liquid droplet which is formed by interfacial tension between the ink and air.

The printing apparatus according to the present embodiment is constructed with an assumption to perform printing on an A4-size printing medium. Assuming that data is fully printed on an A4-size printing medium, the maximum number of dots printed by the color head is $1.26\times10^8$, and the maximum number of dots printed by the black head is $3.17\times10^7$.

Whether or not to perform a wiping operation is decided based on the following determination. Namely, the number of dots (number of printing dots) counted by a dot counter provided in the printing apparatus is stored in the main unit (e.g., memory 122), and it is determined whether or not the number of printing dots has reached a predetermined value after printing is completed.

Note that although the present embodiment is configured to make determination of execution or non-execution of a wiping operation upon completion of printing each page, in a case of a plotter or a large-size printer which prints a large printing area, it may be configured so that the determination of execution or non-execution of a wiping operation is made for each predetermined printing unit, e.g., one scan.

Furthermore, when a printing duty is high, ink mist attached to the discharge surface tends to increase. Therefore, the determination of execution or non-execution of a wiping operation may be made by performing a predetermined calculation using a coefficient that bases upon the number of printing dots and a printing duty, and by comparing the value obtained by calculation with a predetermined threshold value.

The inkjet printing apparatus according to the present embodiment detects the discharge state of all nozzles. In a case where a nozzle that cannot perform normal discharge (faulty nozzle) is detected, recovery is performed by cleaning, or backup printing (also called a complement to faulty discharge) is performed. In backup printing, a dot printed by a faulty nozzle is later printed by another normal nozzle in the printing operation. For this reason, a faulty discharge detection device shown in FIG. 2 is provided.

Figure 2:
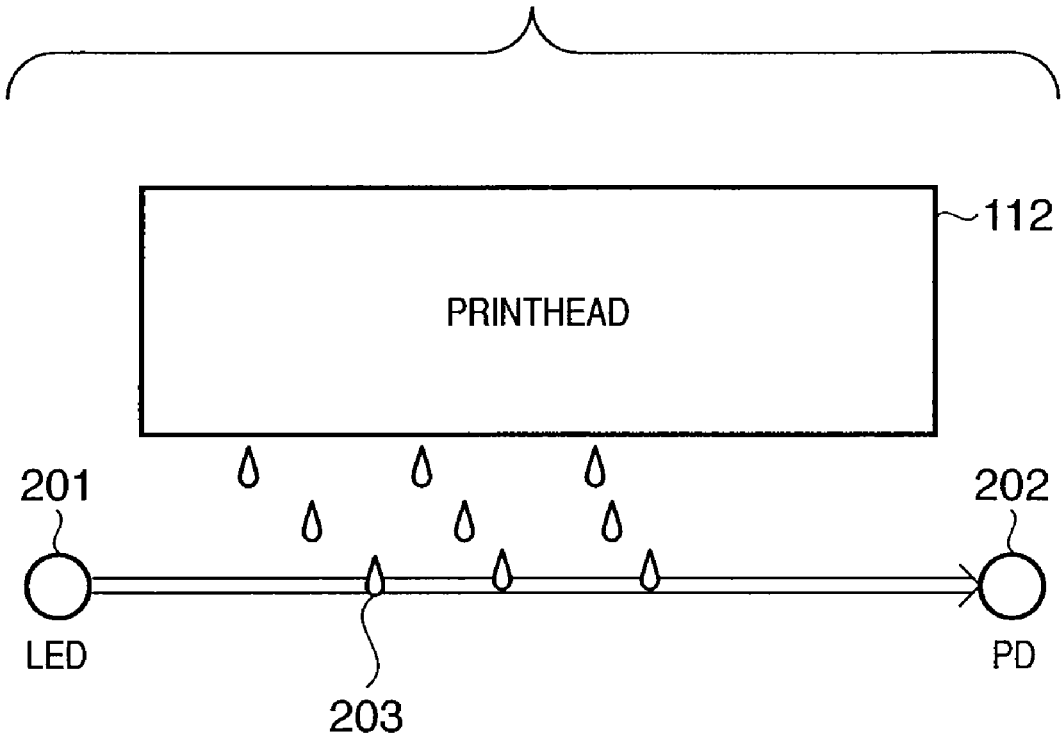
FIG. 2 is a schematic view explaining a faulty discharge detection device according to the first embodiment.

The faulty discharge detection device comprises, as shown in FIG. 2, an LED 201 which emits light having a predetermined wavelength, and a photodiode (PD) 202 which receives the light emitted by the LED and converts the light to an electric signal. The faulty discharge detection device determines the discharge state of each nozzle based on a variation of a signal waveform outputted from the PD 202 when an ink droplet discharged from each nozzle of the printhead 112 interrupts the light flux emitted from the LED 201 to the PD 202.

Figure 10:
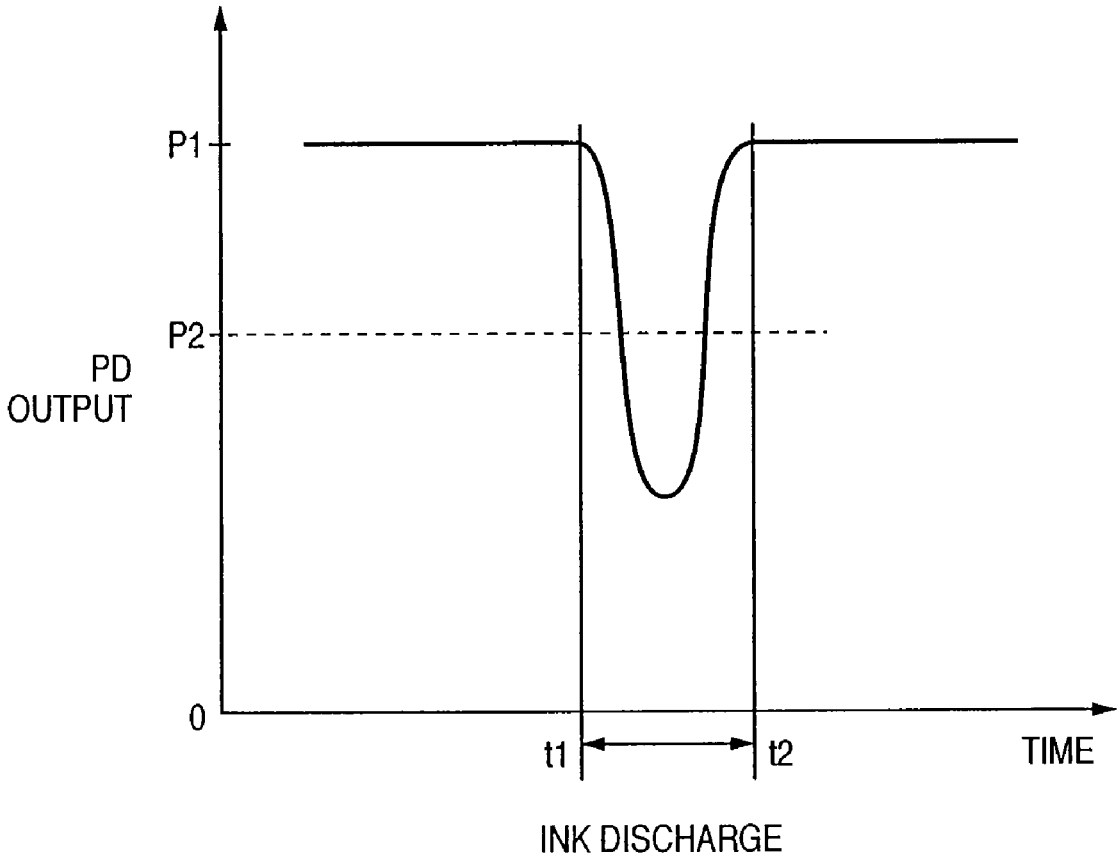
FIG. 10 is a graph showing signals obtained from the faulty discharge detection device according to the first embodiment.

FIG. 10 is a graph showing as an example a variation of a signal level outputted from the PD 202. In the example, ink is discharged from a designated nozzle during the time t1 to t2 (a signal for driving the nozzle is outputted to the printhead). If the level of the output signal does not decrease from the level P1 to a level less than P2 during this period, it is determined that the nozzle is a faulty nozzle.

Figure 1:
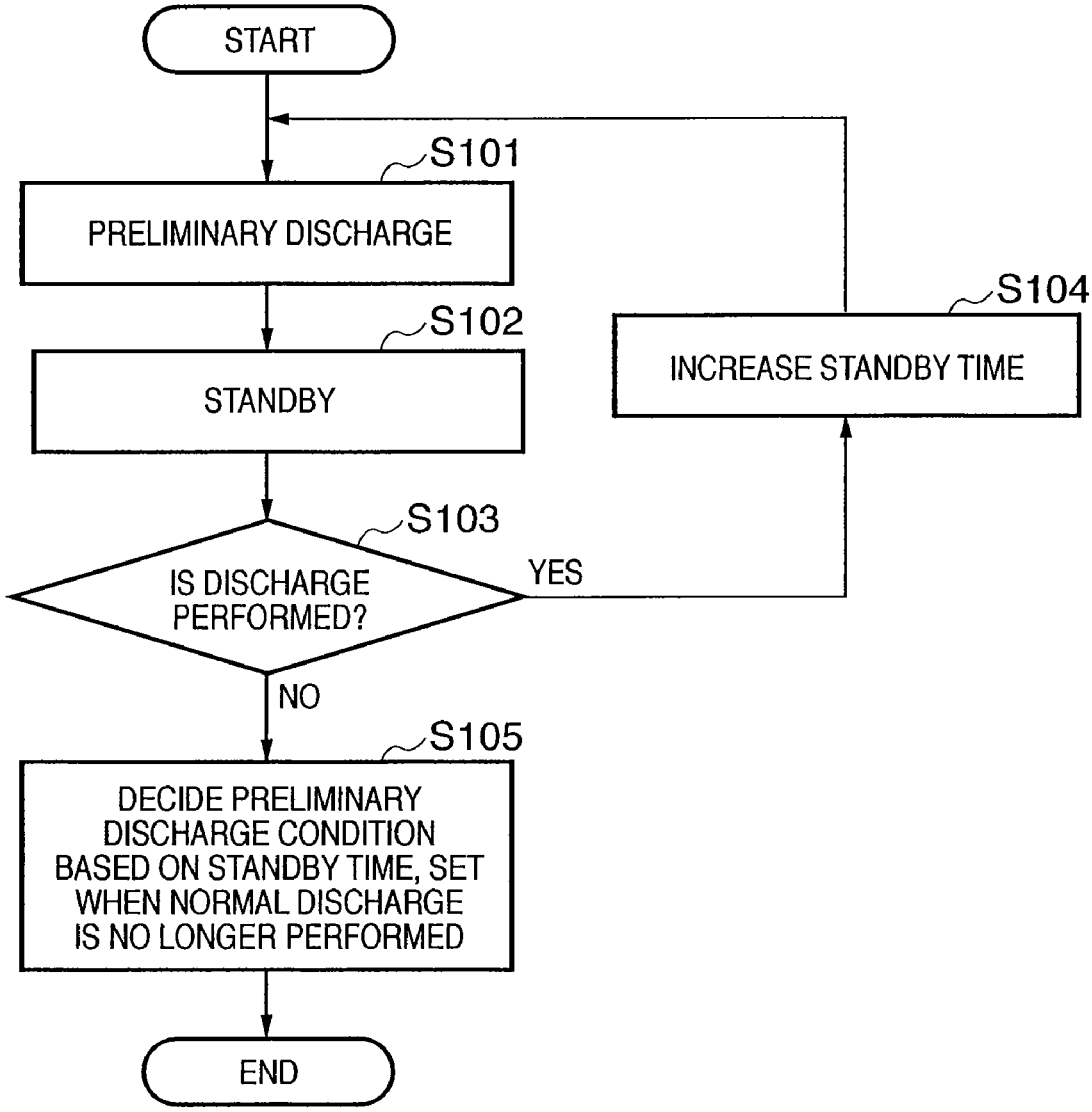
FIG. 1 is a flowchart describing a preliminary discharge condition setting procedure according to a first embodiment.

In the present embodiment, in view of the fact that the ink drying state and the increased viscosity state of ink are influenced by individual differences, usage environment, usage histories (durability) and so forth of the printhead, the setting of the preliminary discharge condition is determined in accordance with the flowchart shown in FIG. 1.

First, preliminary discharge is performed (step S101) and the apparatus stays on standby for a predetermined period (step S102). Then, preliminary discharge is performed again to determine, by the faulty discharge detection device, whether or not normal discharge is performed (step S103). In a case where it is determined that normal discharge is performed, the standby time is increased by a predetermined unit time (step S104), and the control is repeated from step S101. Meanwhile, in a case where it is determined that normal discharge is not performed, the preliminary discharge condition is set based on the currently set standby time (step S105). In the present embodiment, 70% of the standby time, which is set when normal discharge is no longer performed, is set in step S105 as an interval of the preliminary discharge.

As described above, according to the present embodiment, an interval of preliminary discharge that causes discharge failure is obtained, and based on the standby time period that has caused discharge failure, the most appropriate preliminary discharge interval is set. Note that, as mentioned above, since the ink drying state and the increased viscosity state of ink vary depending on the usage environment and usage histories, it is preferable to perform the above setting of the preliminary discharge condition, for instance, each time the power of the printing apparatus is turned on, or at least at regular intervals.

As has been set forth above, according to the present embodiment, the faulty discharge detection device is employed to obtain the standby time that has caused discharge failure, and the preliminary discharge interval is controlled based on the obtained standby time period. By virtue of this control, preliminary discharge can be executed at most appropriate intervals, and it is possible to suppress a decrease in throughput and an increase in the amount of wasted ink, while preventing deterioration in printing quality.

Second Embodiment

Hereinafter, the second embodiment of the present invention is described. The second embodiment also provides an inkjet printing apparatus similar to the first embodiment. In the following description, the part similar to that of the first embodiment will not be described, but characteristic part of the second embodiment will mainly be described.

While the first embodiment controls the preliminary discharge interval based on the standby time that has caused discharge failure, the second embodiment controls the preliminary discharge amount based on the standby time that has caused discharge failure.

In the first embodiment, since the frequency of preliminary discharge execution changes, substantial printing speed also changes. To prevent such change, according to the second embodiment, instead of setting a preliminary discharge interval in step S105 in the flowchart in FIG. 1, the number of ink droplets (number of discharge) discharged by preliminary discharge is set as the preliminary discharge condition.

More specifically, the relation between the standby time that has caused discharge failure and the amount of preliminary discharge (number of discharge) for preventing an occurrence of discharge failure is obtained in advance, and based on the table shown in FIG. 11, the amount of preliminary discharge (number of discharge) is set from the standby time that has caused discharge failure.

According to the second embodiment, it is possible to minimize a decrease in throughput and suppress an increase in the amount of wasted ink, while preventing deterioration in printing quality, as similar to the first embodiment.

Third Embodiment

Hereinafter, the third embodiment of the present invention is described. The third embodiment also provides an inkjet printing apparatus similar to the first and second embodiments. In the following description, the part similar to that of the foregoing embodiments will not be described, but characteristic part of the third embodiment will mainly be described.

While the foregoing embodiments control (set) the preliminary discharge condition based on the standby time that has caused discharge failure, the third embodiment controls (sets) the condition of preliminary discharge on a sheet based on the standby time that has caused discharge failure.

More specifically, the printing apparatus according to the third embodiment does not execute normal preliminary discharge which is performed at a predetermined position outside the printing area, but executes preliminary discharge on a sheet, in which microscopic dots that are microscopic enough so as not to affect the appearance are discharged at microscopic density in a printing area of a printing medium.

The higher the density of the preliminary discharge on a sheet, the more the discharge failure occurrence can be prevented, but the printing quality deteriorates. In view of this, according to the third embodiment, the relation between the standby time that has caused discharge failure and the density of preliminary discharge on a sheet for preventing discharge failure occurrence is obtained in advance. Based on the table shown in FIG. 12, the density of preliminary discharge on a sheet is set from the standby time that has caused discharge failure. Note that the set density herein indicates a ratio between the number of discharge performed in the preliminary discharge on a sheet and the number of ink dischargeable in a predetermined area. Therefore, the number of dots dischargeable in a predetermined area is decided in accordance with printing resolution, and based on the number of dots, the density of preliminary discharge on a sheet is set.

Furthermore, according to the third embodiment, in order to prevent deterioration in printing quality, an upper limit is set for the density of the preliminary discharge on a sheet. In a case where the standby time that has caused discharge failure is shorter than the standby time corresponding to the upper limit of the density, the preliminary discharge interval is reduced.

FIG. 13 shows an example of a table employed in the present embodiment. As shown in the table, in a case where the standby time that causes discharge failure is less than 6 seconds, the density of preliminary discharge on a sheet is set in $4/10{,}000$. In a case where the standby time that has caused discharge failure is equal to or more than 2 seconds and less than 4 seconds, the interval of preliminary discharge is reduced by 1 second. In a case where the standby time that has caused discharge failure is less than 2 seconds, the interval of preliminary discharge is reduced by 2 seconds.

According to the third embodiment, it is possible to minimize a decrease in throughput and suppress an increase in the amount of wasted ink, while preventing deterioration in printing quality, as similar to the first and second embodiments.

Fourth Embodiment

Hereinafter, the fourth embodiment of the present invention is described. The fourth embodiment also provides an inkjet printing apparatus similar to the first to third embodiments. In the following description, the part similar to that of the foregoing embodiments will not be described, but characteristic part of the fourth embodiment will mainly be described.

Each of the foregoing embodiments controls (sets) the preliminary discharge condition based on the standby time that has caused discharge failure. However, in the fourth embodiment, in light of the fact that the time lag between a designation of discharge and actual detection of an ink droplet becomes long before an occurrence of discharge failure, the preliminary discharge is controlled in accordance with the length of the time lag.

Figure 14:
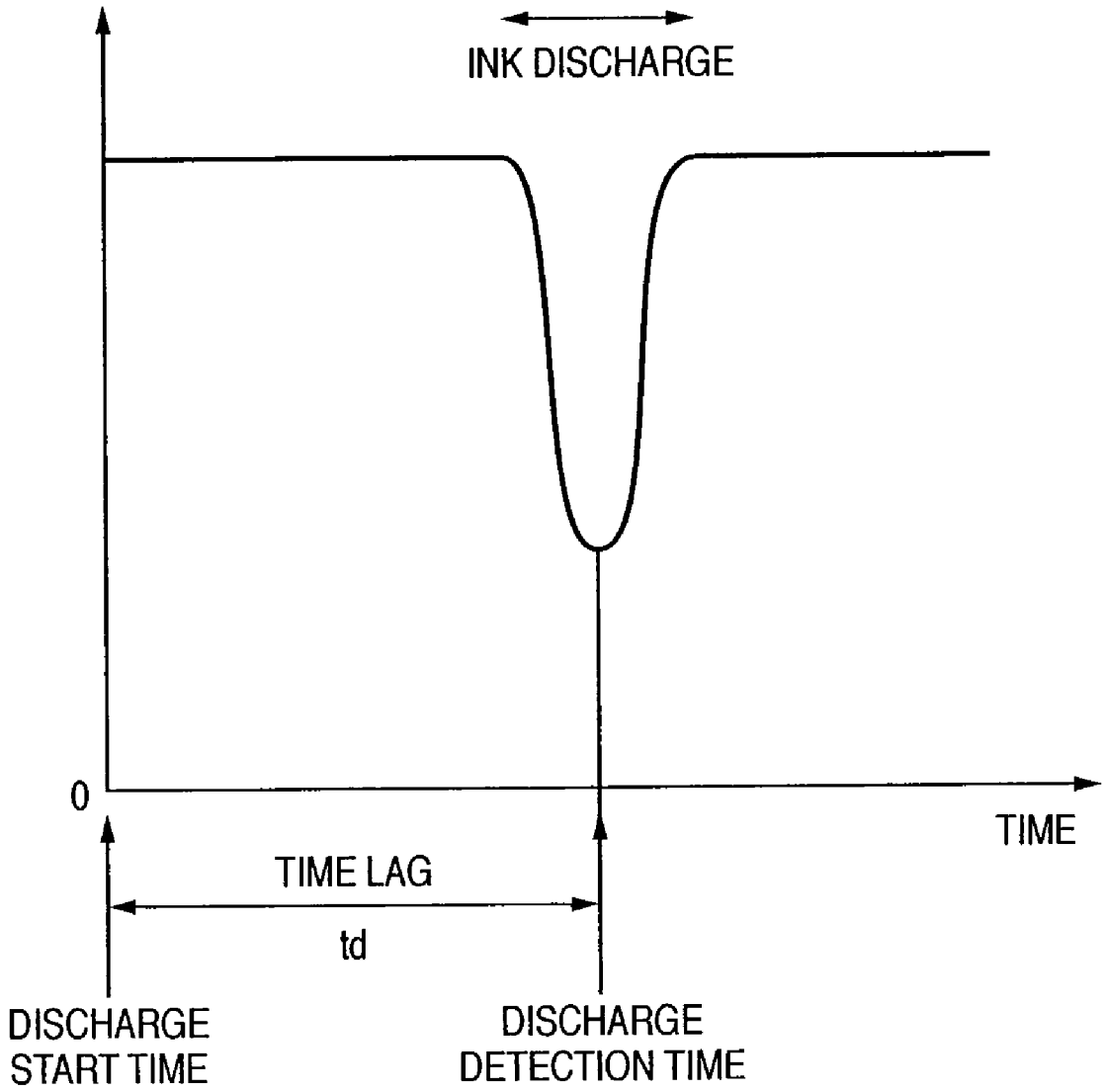
FIG. 14 is a graph showing a time lag according to a fourth embodiment.

Between an excellent discharge state and a discharge failure state, there is a state in which discharge is performed but the discharge speed is low. When the discharge speed becomes low, the ink landing position changes, exerting a negative influence on the printing quality. According to the fourth embodiment, in order to prevent deterioration in printing quality caused by such low discharge speed, the faulty discharge detection device detects a time lag between the time of discharge designation (time at which a nozzle driving signal is applied) and ink droplet detection. FIG. 14 is a graph describing a time lag according to the fourth embodiment. As shown in the graph, the time lag td between discharge designation and ink droplet detection is detected.

Based on the time lag, the amount of preliminary discharge is controlled in this embodiment. FIG. 15 is a table showing a relation between the time lag and the number of preliminary discharge, which is employed in the fourth embodiment.

According to the fourth embodiment, it is possible to minimize a decrease in throughput and suppress an increase in the amount of wasted ink, while more effectively preventing deterioration in printing quality, as similar to the above-described embodiments.

Other Embodiment

Although the above embodiments describe as an example an inkjet printing apparatus employing a serial printing method, the present invention is applicable to an inkjet printing apparatus adopting other methods such as a full-line printing method.

Furthermore, the invention can be implemented by supplying a software program (corresponding to the flowchart shown in FIG. 1, and tables shown in FIGS. 11, 12 and 15) which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-056663 filed on Mar. 1, 2004, which is hereby incorporated by reference.

What is claimed is:

1. An inkjet printing apparatus for performing printing of an image using a printhead having a plurality of discharge orifices for discharging ink, the inkjet printing apparatus comprising:

control means for executing a preliminary discharge by the printhead before a predetermined time has elapsed since the latest preliminary discharge, in printing of an image; and setting means for setting the predetermined time, wherein the setting means obtains an elapsed time after executing the preliminary discharge until a discharge failure occurs in any one of the plurality of discharge orifices, and sets the elapsed time as the predetermined time.

2. The inkjet printing apparatus according to claim 1, wherein the setting means operates in a test mode to set the predetermined time, and wherein in the test mode, an operation, in which a second preliminary discharge is executed after a first preliminary discharge, is executed a plurality of times while changing a time interval between the first preliminary discharge and the second preliminary discharge, and the elapsed time after executing the first preliminary discharge until a discharge failure occurs in any one of the plurality of discharge orifices is obtained when detecting that the discharge failure has occurred in any one of the plurality of discharge orifices in the second preliminary discharge.

3. The inkjet printing apparatus according to claim 2, wherein in the test mode, the operation, in which the second preliminary discharge is executed after the first preliminary discharge, is executed a plurality of times while increasing the time interval between the first preliminary discharge and the second preliminary discharge.

4. A preliminary discharge control method for an inkjet printing apparatus for executing a preliminary discharge by a printhead having a plurality of discharge orifices for discharging ink before a predetermined time has elapsed since the latest preliminary discharge, in printing of an image using the printhead, the preliminary discharge control method comprising:

an obtaining step of obtaining an elapsed time after executing the preliminary discharge until a discharge failure occurs in any one of the plurality of discharge orifices;

an updating step of updating the elapsed time obtained in the obtaining step as the predetermined time; and a printing step of printing an image while executing the preliminary discharge by the printhead before the time updated in the updating step elapses.

5. The preliminary discharge control method according to claim 4, wherein in the obtaining step, an operation, in which a second preliminary discharge is executed after a first preliminary discharge, is executed a plurality of times while changing a time interval between the first preliminary discharge and the second preliminary discharge, and the elapsed time after executing the first preliminary discharge until a discharge failure occurs in any one of the plurality of discharge orifices is obtained when detecting that the discharge failure has occurred in any one of the plurality of discharge orifices in the second preliminary discharge.

6. The preliminary discharge control method according to claim 5, wherein in the obtaining step, the operation, in which the second preliminary discharge is executed after the first preliminary discharge, is executed a plurality of times while increasing the time interval between the first preliminary discharge and the second preliminary discharge.

* * * * *